United States Patent [19]

Yonezawa

[11] Patent Number: 4,990,117

[45] Date of Patent: Feb. 5, 1991

[54] MAGNETIC FORCE-GUIDED TRAVELLING TOY

[75] Inventor: Shigeru Yonezawa, Tokyo, Japan

[73] Assignee: Yonezawa Corporation, Tokyo, Japan

[21] Appl. No.: 427,790

[22] Filed: Oct. 27, 1989

[30] Foreign Application Priority Data

Oct. 27, 1988 [JP] Japan ..... 63-140286[U]
Aug. 23, 1989 [JP] Japan ..... 1-98336[U]

[51] Int. Cl.[5] ..... A63H 33/26; A63H 18/00; A63H 17/36

[52] U.S. Cl. ..... 446/136; 446/129; 446/444; 446/468

[58] Field of Search ..... 446/136, 129, 130, 131, 446/135, 431, 441, 444, 445, 446, 447, 440, 457, 460, 462, 468

[56] References Cited

U.S. PATENT DOCUMENTS

| | | | |
|---|---|---|---|
| 2,618,101 | 11/1952 | Berger | 446/460 |
| 2,690,626 | 10/1954 | Gay et al. | 446/130 X |
| 3,121,971 | 2/1964 | Nyc | 446/130 |
| 3,403,470 | 10/1968 | Werner | 446/130 |
| 3,584,410 | 10/1969 | Lalonde | 446/130 |
| 3,816,958 | 6/1974 | Winston | 446/462 |
| 4,156,986 | 6/1979 | Kupperman et al. | 446/462 |
| 4,327,519 | 5/1982 | Cooper et al. | 444/444 |
| 4,443,967 | 4/1984 | Jones et al. | 446/462 |
| 4,504,243 | 3/1985 | Barlow et al. | 446/444 X |
| 4,565,538 | 1/1986 | Kennedy et al. | 446/462 X |
| 4,658,928 | 4/1987 | Seo | 446/129 X |
| 4,799,431 | 1/1989 | Edwards et al. | 446/467 |

FOREIGN PATENT DOCUMENTS

| | | | |
|---|---|---|---|
| 1048527 | 1/1959 | Fed. Rep. of Germany | 446/129 |
| 3409975 | 9/1985 | Fed. Rep. of Germany | 446/444 |
| 784805 | 10/1957 | United Kingdom . | |
| 876054 | 8/1961 | United Kingdom . | |
| 1127520 | 12/1965 | United Kingdom . | |
| 1408815 | 10/1975 | United Kingdom . | |
| 2102687 | 2/1983 | United Kingdom . | |

*Primary Examiner*—Robert A. Hafer
*Assistant Examiner*—D. Neal Muir
*Attorney, Agent, or Firm*—Darby & Darby

[57] ABSTRACT

A toy vehicle travels on the surface of a travel board, following a path of magnetically attractive material. The toy vehicle has a single drive wheel located centrally on the bottom of the vehicle's body. The center of gravity of the vehicle resides substantially over the single drive wheel so that the vehicle is balanced. A magnet located in the front of the vehicle is attracted to the magnetic path on the travel board. The magnetic attraction directly steers the vehicle about the central drive wheel along the path.

9 Claims, 5 Drawing Sheets

MAGNETIC FORCE-GUIDED TRAVELLING TOY

FIELD OF THE INVENTION

The present invention relates to magnetic-force guided travelling toys. Specifically, those travelling toys which include a toy body which is driven along the surface of a travel board. The toy body follows a prescribed path along the travel board, guided by magnetic attraction.

BACKGROUND OF THE INVENTION

There have been various types of travelling toys which use magnetism to guide a toy body along a path on a board. Japanese Utility Model Publication No. Sho-36-12938 discloses an example of one such prior art travelling toy.

In the Sho-36-12938 publication, a travelling toy body follows a guide path which is made from a plate of a non-ferromagnetic material having embedded therein a ferromagnetic material, in the form of wire or tape. The travelling toy body of the Sho-36-12938 has front and rear wheels. The front wheels are attached to an axle. The axle includes a vertical swing shaft which pivotally connects the front axle to the toy body, and a forwardly (horizontal) projected arm. A magnet is disposed along the remote end of the projected arm.

In operation of the toy of the Sho-36-12938 publication, as the toy body moves forward, the magnet at the most forward end of the projected arm is attracted to the ferromagnetic guide path, and moves the arm horizontally, side to side, as the direction of the path changes. The side-to-side movement of the arm causes the front axle to move about the swing shaft, and in turn, causes the front wheels to direct the toy body along the guide path.

There are problems with the above-described prior art travelling toys. Among these problems is the inability of the prior art toy body to follow a sharply curved guide path, or a path having many close opposing turns. If the guide path is formed with many small radius turns or turns directed to the right, for example, then to the left, then to the right, etc., the driven toy body of the prior art cannot react quickly enough to follow the path and invariably will leave the guided path altogether and wander guidelessly across the travel board.

An object of the invention is to provide a magnetically guided travelling toy which overcomes the above-described problems.

Another object of the invention is to provide a magnetically guided travelling toy that may be driven along a sharply curved guide path on a travel board.

Another object of the invention is to provide a magnetically guided travelling toy which is compact and simple in construction and easy for a child to operate and handle.

SUMMARY OF THE INVENTION

The present invention provides a magnetically guided travelling toy which includes a travel board having an embedded guide path which is made from a magnetically attractive material for guiding a toy body therealong. The toy body has a bottom surface and a front end. Means for driving the toy body along the travel board is attached to the body and includes a drive wheel which is located substantially in the center of the bottom surface so that the center of gravity of said toy resides substantially over the drive wheel. A magnet is attached to the body in front of the drive wheel. As the body moves forward, the magnet attracts with the magnetically attractive material of the guide path, thereby steering the body along the guide path. Since the center of gravity of the toy resides effectively over a single point, the drive wheel, the toy body resists little to sudden direction changes and easily follows a sharply curved guide path. Means is provided for supporting the front end of the body above the travel board against the pull developed between the magnet and the guide path.

DETAILED DESCRIPTION OF THE PREFERRED EMBODIMENT

Figure 1:
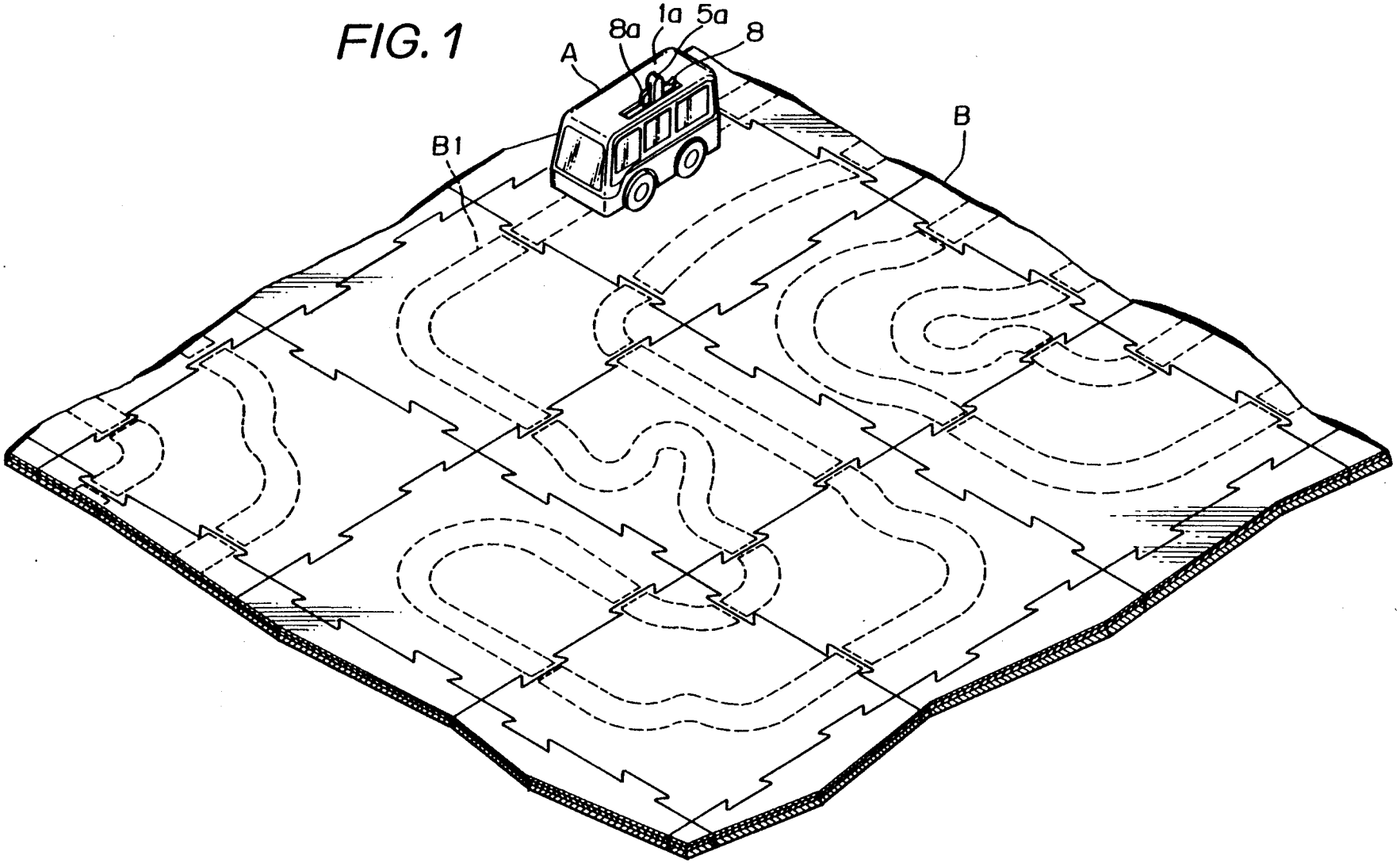
FIG. 1 is a perspective view showing a travelling body on a travel board, in accordance with the invention.

Referring to FIG. 1, a travelling body A of the present invention is shown on one surface of a travelling board B, following a guide path B1. The guide path B1 is represented in dashed lines to indicate that it is embedded in the travel board B.

Figure 2:
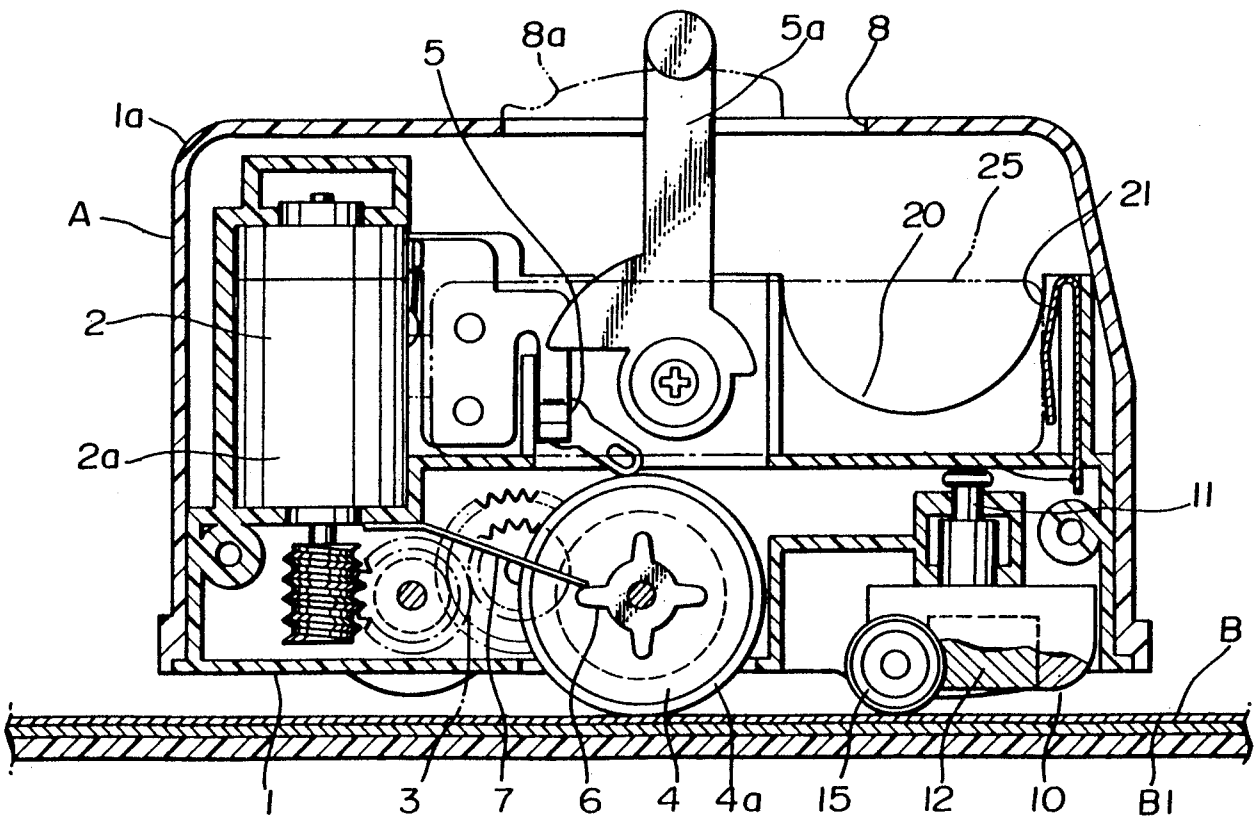
FIG. 2 is a partial sectional side view of the travelling body.
Figure 3:
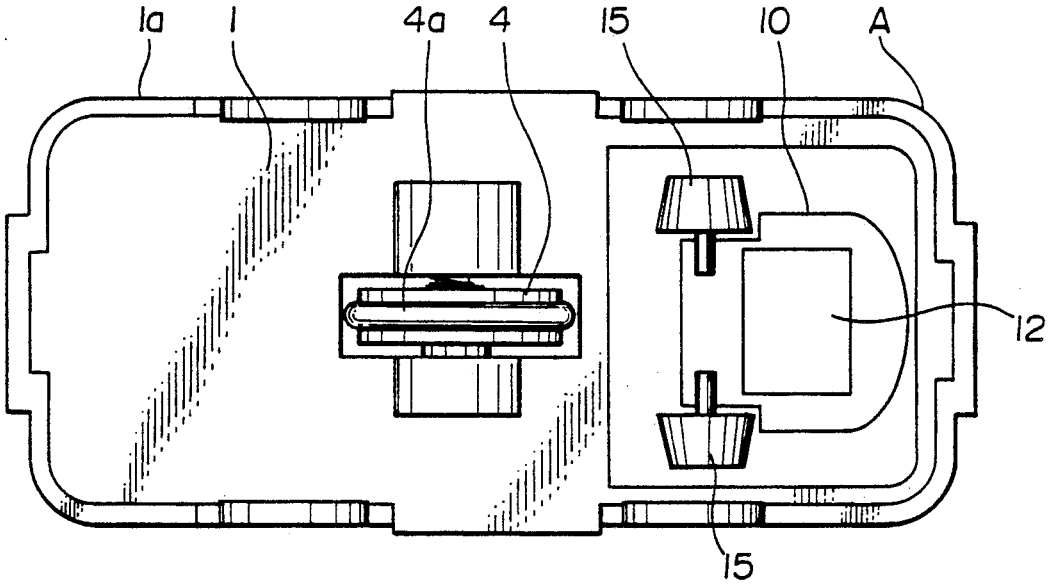
FIG. 3 is a bottom view of the travelling body.
Figure 4:
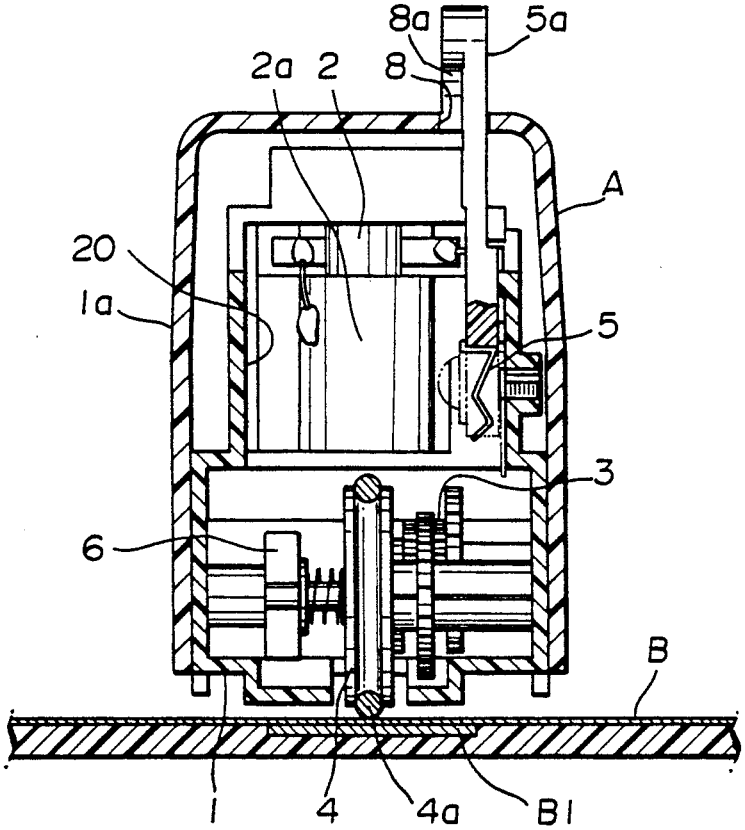
FIG. 4 is a partial sectional front view of the travelling body.

Details of one embodiment of the travelling body A is shown in FIGS. 2–4. The body A includes a base 1 and an outer frame 1*a*. The outer frame 1*a* is engageable with the base body 1 from an upper side and includes designs like that of the body of an automobile or a bus. The body base 1 houses a drive means comprising a motor 2, a deceleration gear row 3 and a drive wheel 4. The body base 1 also includes a battery 25 for powering the motor 2, a switch assembly 5 for controlling the power from the battery 25 to the motor 2, and a guide swing body 10 for assisting the changing of direction of the travelling toy.

During operation, the motor 2, powered by battery 25 through switch assembly 5 rotates the deceleration gear row 3 and causes the drive wheel 4 to rotate. The drive wheel 4 is in frictional contact with the surface of the travel board B. The rotation of the drive wheel 4 causes the travelling body A to move along the surface of the board B. To increase the gripping friction between the drive wheel 4 and the surface of the board B, a rubber ring 4*a* (or rubber strap) having a circular cross-section is attached along the outer periphery of the drive wheel 4, so that the rubber ring 4*a* contacts the board B and helps move the travelling body A. The drive wheel 4 is rotatably mounted to a drive wheel axle 4*b* which is attached to the body base 1. Also mounted (fixed) to the drive wheel axle 4*b* is a drive gear 4*c* of the deceleration gear row 3.

A picking plate star wheel 6 is also fixed to the drive axle 4*b* and rotates whenever the drive gear 4*c* rotates the drive axle. The drive wheel 4 is frictionally engaged with the star wheel 6 using a spring clutch arrangement which is shown in FIG. 4. The clutch arrangement, which is intended to prevent damage to the gear row 3 during any unintended drive wheel movement, includes a spring 4*d* which is positioned around the drive wheel axle 4*b*. The spring 4*d* is arranged to frictionally engage one surface of the drive wheel 4 with the star wheel 6. The star wheel 6 is described in greater detail below.

The switch assembly 5, as shown in FIGS. 2 and 4, controls the flow of current between the battery 25 and the motor 2. The switch assembly 5 includes a switch lever 5*a* which is pivotally mounted to a portion of the base body 1 (the arrow 5*b* indicates the direction of travel of the switch lever 5*a*). The switch lever 5*a* preferably projects upwardly through the outer frame 1*a*. The outer frame 1*a* includes an elongated opening 8 to receive the switch lever 5*a* and allow for its pivotal movement 5*b*.

Located at the remote end of the switch lever 5*a* and formed integrally is a transversely disposed engagement tab 5*c*. The elongated opening 8 is formed by a "through" opening 8*b* and an adjacent slot-like opening 8*c*. The "through" opening 8*b* is large enough to receive the engagement tab 5*c*, but the slot-like opening 8*c* is wide enough only to receive the switch lever 5*a* just below the engagement tab 5*c* and allow swinging movement of the lever 5*a*. An engagement plate 8*a* is positioned adjacent one longitudinal edge of the slot-like opening 8*c*. The engagement plate 8*a* has an arcuate engagement surface along which the engagement tab slides. The engagement plate 8*a* also includes detents 8*d* which form a friction-stop point to indicate a prescribed position of the switch lever 5*a*, such as the "on" or "off" position.

In operation of the switching assembly 5, once the engagement tab 5*c* of the switch lever 5*a* is passed through the "through" opening 8*b* and moved over to contact the engagement surface of the engagement plate 8*a*, the outer frame 1*a* becomes secured to the base body 1, held by the switch lever 5*a*. Once the outer frame 1*a* is secured to the base body 1, the switch lever 5*a* may still be slid between two stop detents 8*d*, located along the engagement plate 8*a*, to operate the motor 2.

One terminal (+ terminal) of the motor 2 is connected with the outer casing 2*a* of the motor 2. The outer casing 2*a* is used as a terminal contact for the positive electrode of the battery 25. The negative terminal of the motor 2 is connected through the switch assembly 5. A terminal assembly 21 connects the negative terminal of the battery 25 with the switch assembly 5 so that when the switch assembly is turned "on", the negative terminal of the battery 25 makes electrical contact with the negative terminal of the motor 2. The terminal assembly 21 is attached to the base body 1, in the battery case 20, and is used to hold the battery 25 in place, between positive and negative terminals.

The drive means is not limited to the above-described arrangement (i.e., electric motor drive). Other drives may also be employed such as the use of a spiral spring arrangement to accumulate a winding force.

A sound producing means is provided with the invention for producing a particular sound when the drive wheel is rotated. One sound producing arrangement includes an elongated sound plate 7 which has one end fixed to the base body 1, and the other remote end in an engaging position with the previously described picking plate star wheel 6. As the drive wheel axle rotates, the star wheel 6 rotates and the individual plates of the star wheel 6 intermittently engage the remote end of the sound plate 7, "picking" the plate 6 and generating the particular sound.

Referring to FIGS. 2 and 4, the guide swing body 10 is mounted in the front of the base body 1 and may swing horizontally about a vertical shaft 11. The shaft 11 connects an upper central portion of the guide swing body 10 to the front of the bottom surface of the base body 1. The shaft 11 includes a circumferential groove which is received by an appropriately shaped opening in the base body 1 so that the guide swing body 10 may freely pivot about the shaft 11, but remains attached to the toy body A.

Support wheels 15 are rotatably connected to a rear portion (behind the central shaft 11) of the guide swing body 10 with an axle.

A magnet 12 is connected to a lower surface of the guide swing body 10 (preferably in a recess). The magnet 12 is located somewhat forward of the shaft 11 so that as the toy body A moves along the guide path, the magnet 12 will attract to the guide path and move the guide swing body 10 about the shaft 11. As the guide swing body 10 moves about the shaft 11, the support wheels 15 will swing in the opposite direction about the shaft 11 (into the turn of the guide path) and help redirect the toy body around the turn. The support wheels 15 also function as support for the toy body A, preventing it from falling over while turning.

Figure 5:
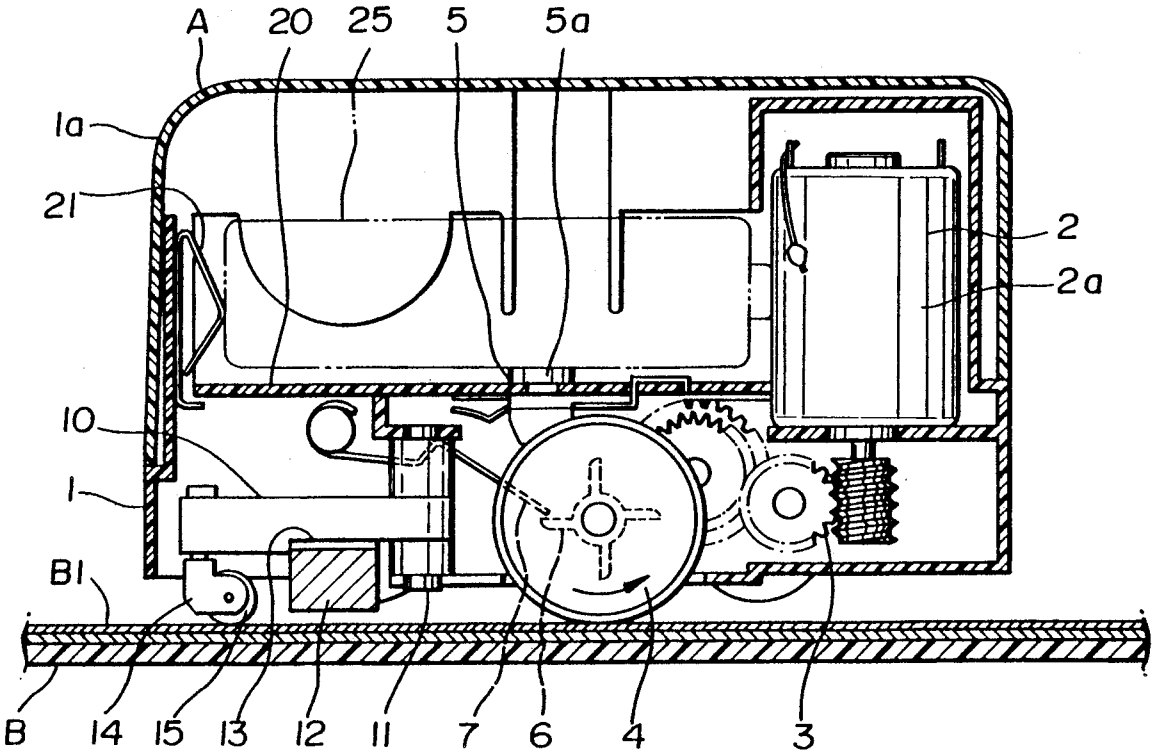
FIG. 5 is a partial sectional side view of a travelling body in accordance with another embodiment of the invention.
Figure 6:
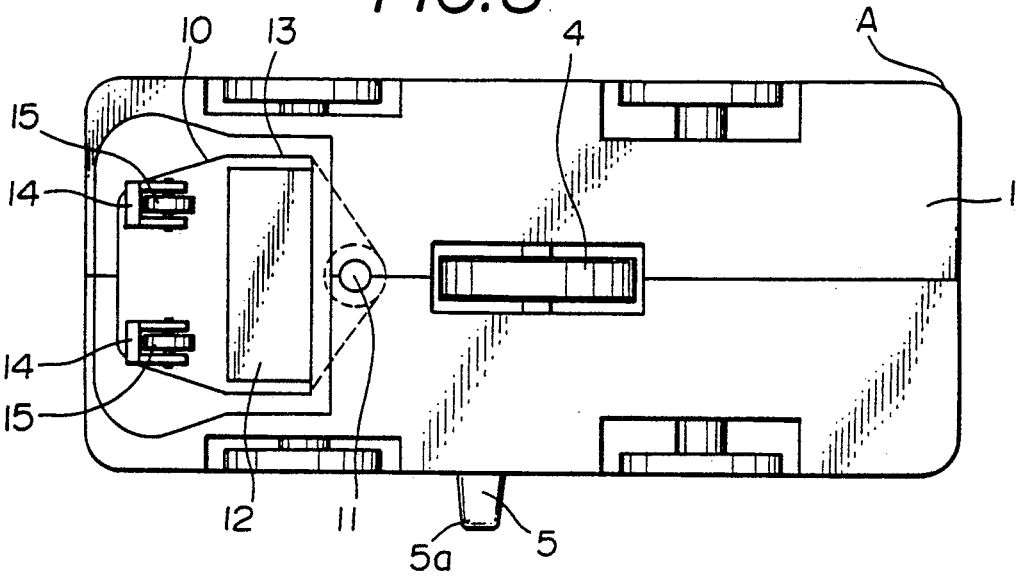
FIG. 6 is a bottom view of the travelling body of FIG. 5.
Figure 7:
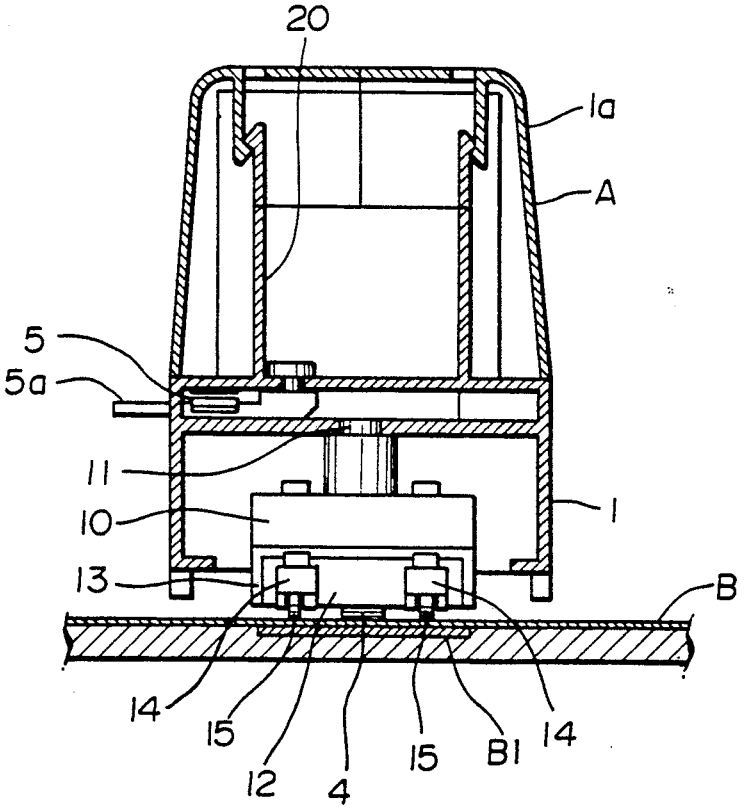
FIG. 7 is a partial sectional front view of the travelling body of in FIG. 5 and FIG. 6.

Referring to FIGS. 5 through 7, a second embodiment of the invention is shown, specifically, the guide swing body 10. Here, the shaft 11 connects a rear portion of the guide swing body to the base body 1 of the toy body A. The magnet 12 is connected to the lower surface of the guide swing body 10, forward of the shaft 11. Two support wheels 15, mounted in caster-like housings 14, are attached to the front portion of the guide swing body 10, forward of the magnet 12.

* The second version of the guide swing body 10, described above, operates in a similar fashion to the preferred embodiment. As the magnet 12 is attracted to the guide path, the guide swing body 10 moves about the shaft and moves the supporting wheels 15 in the same direction. In this case, since the wheels 15 are allowed to independently pivot (like casters) they do not assist in the steering of the toy body A, only in supporting the body around a turn. The toy body A is steered by the attraction between the magnet 12 and the guide path.

In another embodiment (not shown), the shaft 11 may be fixed to the base body 1, and pivotally attached to the upper surface of the guide swing body 10.

Although not necessary, the magnet 12 is preferably held in its recess in the guide swing body 10 by a metallic holder 13. The holder 13 not only secures the magnet within the recess, but also enhances and directs the magnetic field towards the guide path.

The travel board B can be constructed by combining various travel plates together. Each travel plate includes along each connecting edge, a pair of hook shapes which are shaped to interlock with any other pair of hook shapes so that a variety of travel board constructions may result, each with a uniquely shaped guide path.

In operation of the travelling toy, first the travel board having a desired guide path arrangement is assembled by interlocking the peripheral hook shapes of the travel plates to each other. The toy body A (with a battery in place) is "turned-on" by moving the switch arm 5*a* from the "off" stop detent 8*d*, to the "on" detent 8*d*. This action electrically connects the battery 25 to the drive motor 2, activating the motor 2. The motor rotates the gears of the gear row 3, and eventually rotates the drive gear and the drive wheel axle 4*b*. The star wheel 6, being fixed to the drive axle 4*b* also rotates, producing the clicking sound. The spring clutch assembly 4*d* engages and frictionally rotates the drive wheel 4.

The toy body A is placed upright on the surface of the travel board B, adjacent or over the guide path. As the drive wheel 4 rotates, the rubber ring 4*a* contacts the board surface and moves the vehicle forward.

As the toy body moves forward, the magnet 12 attracts with the magnetically attractive guide path. This attraction causes the guide swing body 10 to swing horizontally left or right about the shaft 11. The swinging guide swing body 10 aligns the wheels 15 to the intended or desired coarse to keep the toy body on the guide path.

The magnet 12, with its holder 13 maintains a strong attraction with the guide path. The strength of this attraction and the evenly distributed weight of the toy body over the centrally located drive wheel 4, enable the toy body to respond quickly to direction changes so that it may follow a sharply curved guide path.

When the switch arm 5*a* is swung past the engagement plate 8*a*, the outer frame is released and may be removed from the base body 1 to access the battery 25 and the battery holder 20.

I claim:

1. A travelling toy guided by magnetic force capable of travelling along a guide path made of magnetically attractive material and provided on a travel board, said travelling toy comprising:

a body having a bottom surface and a front end;

means for driving said body forward along said guide path, said drive means being attached to said body and including a drive wheel which contacts said travel board, said drive wheel being located substantially in the center of said bottom surface so that the center of gravity of said toy resides substantially over said drive wheel;

a magnet attached to said body in front of said drive wheel, said magnet being attracted to said magnetically attractive material of said guide path so that said magnet steers said body along said guide path as said toy is driven forward by said drive means, said magnet steers said body about said centrally located drive wheel;

means for supporting said front end of said body above said guide board against the pull of said magnet and said magnetically attractive material.

2. The travelling toy according to claim 1 further comprising a guide swing portion attached to said front of said body, said guide swing portion being pivotal about a swing axis, wherein said magnet is attached to said guide swing portion in front of said swing axis and said support means is attached to said guide swing portion behind said swing axis, said magnet following said guide path causes movement of said guide swing portion which, in turn, assists in directing said body along said guide path.

3. The travelling toy according to claim 1 wherein said drive means includes an electrically powered motor connected to said drive wheel through a set of gears, said motor being powered by a battery located on board said body.

4. The travelling toy according to claim 3 wherein said motor has a metallic casing and two isolated electrical terminals, one of said electrical terminals being electrically connected to said casing, said motor being arranged within said body with respect to said battery so that one of said battery terminals makes electrical contact with said motor casing and therefore establishes electrical contact to said one electrical motor terminal.

5. The travelling toy according to claim 1 wherein said support means includes a pair of wheels rotatably attached to said body.

6. The travelling toy according to claim 1 further comprising a body covering for decorative securement to the upper portion of said body.

7. The travelling toy according to claim 3 wherein said power between said battery and said motor is controlled by a switch arm pivotally attached to said body at a lower end, said switch arm protrudes from said body and includes a lower portion adjacent said lower end having a first thickness and an upper portion having a second thickness, said first thickness is less than said second thickness.

8. The travelling toy according to claim 7 wherein said body covering includes a elongated slot adjacent to an opening, said opening being large enough to receive both said lower and upper potion of said switch arm, said slot being aligned with respect to the pivotal movement of said switch arm and sized to receive only said lower portion of said switch arm, said upper portion, being larger, thereby abuts said body covering adjacent said slot and secures said body covering to said body.

9. The travelling toy according to claim 8 wherein said body covering includes an arcuate engagement plate adjacent to one side of said slot for slidably receiving said upper portion of said pivotal switch arm, said engagement plate having detents for resistively indicating the power being supplied to said motor.

* * * * *